US006682042B2

(12) United States Patent
Anderson

(10) Patent No.: US 6,682,042 B2
(45) Date of Patent: Jan. 27, 2004

(54) COLLAPSIBLE MUSIC STAND

(75) Inventor: Gary Anderson, 2005 Upton Ave. South, Minneapolis, MN (US) 55405

(73) Assignee: Gary Anderson, Minneapolis, MN (US)

( * ) Notice: Subject to any disclaimer, the term of this patent is extended or adjusted under 35 U.S.C. 154(b) by 0 days.

(21) Appl. No.: 10/382,298

(22) Filed: Mar. 5, 2003

(65) Prior Publication Data

US 2003/0178544 A1 Sep. 25, 2003

Related U.S. Application Data

(60) Provisional application No. 60/361,674, filed on Mar. 5, 2002.

(51) Int. Cl.[7] ..... A47B 97/04
(52) U.S. Cl. ..... 248/460; 248/461
(58) Field of Search ..... 248/441 R, 441.1, 248/460, 461, 462

(56) References Cited

U.S. PATENT DOCUMENTS

| | | | | |
|---|---|---|---|---|
| 3,596,866 A | | 8/1971 | Baker | 248/461 |
| 3,637,172 A | | 1/1972 | Diesbach | 248/460 |
| 3,813,074 A | * | 5/1974 | Mulvaney | 248/452 |
| 4,116,413 A | * | 9/1978 | Andersen | 248/451 |
| 4,321,874 A | | 3/1982 | Cenna, III | 108/99 |
| 4,355,779 A | * | 10/1982 | Heled | 248/460 |
| 4,448,384 A | | 5/1984 | Jones, Jr. et al. | 248/443 |
| 4,471,933 A | | 9/1984 | Nelson | 248/461 |
| 4,561,339 A | * | 12/1985 | Jensen | 84/453 |
| 4,813,644 A | | 3/1989 | Goldner | 248/441.1 |
| 4,819,902 A | | 4/1989 | Wenger et al. | 248/460 |
| 5,016,852 A | * | 5/1991 | Herendeen | 248/461 |
| 5,037,057 A | | 8/1991 | Andrews | 248/460 |
| 5,114,111 A | | 5/1992 | Andrews | 248/460 |
| 5,165,631 A | | 11/1992 | Norsworthy | 248/121 |
| 5,356,109 A | | 10/1994 | Biasini | 248/448 |
| 5,564,661 A | | 10/1996 | Gershon | 248/167 |
| 5,636,824 A | | 6/1997 | Biasini et al. | 248/441.1 |
| 5,692,719 A | | 12/1997 | Shepherd | 248/460 |
| 5,791,624 A | | 8/1998 | Fedrick | 248/460 |
| 5,833,199 A | | 11/1998 | Benting et al. | 248/441.1 |
| 5,941,496 A | | 8/1999 | Banner | 248/459 |
| 5,979,856 A | | 11/1999 | Hsu | 248/441.1 |
| 6,017,011 A | | 1/2000 | Lee | 248/441.1 |
| 6,193,204 B1 | | 2/2001 | Hsu | 248/441.1 |
| 6,237,887 B1 | | 5/2001 | Banner | 248/459 |
| 6,260,812 B1 | | 7/2001 | Auke | 248/460 |
| 6,264,161 B1 | | 7/2001 | Waggoner | 248/460 |
| 6,293,511 B1 | | 9/2001 | Shepherd | 248/441.1 |

FOREIGN PATENT DOCUMENTS

DE 198 27 942 A1 * 4/1999

OTHER PUBLICATIONS

Heirloom Traditional Stands, *Traditional Stands*, Dec. 18, 2001, pp. 1.

Alden Lee Company, Inc., *Music Stands*, Dec. 18, 2001, pp. 3.

* cited by examiner

*Primary Examiner*—Leslie A. Braun
*Assistant Examiner*—Kofi Schulterbrandt
(74) *Attorney, Agent, or Firm*—Patterson, Thuente, Skaar & Christensen,P.A.

(57) ABSTRACT

A collapsible music stand including a ground engaging base portion, an upright portion, and a selectively collapsible desk portion. The desk has a pair of body portions operably coupled by a pair of over-center toggle linkages. Each over-center toggle linkage is selectively positionable in at least a first favored position, wherein the linkage is extended so that the body portions are spaced apart and the linkage opposes movement of the body portions toward each other. Further, the toggle linkages are positionable in a second favored position wherein the body portions are freely movable toward each other to collapse the desk. The desk further includes at least one resilient element arranged so as to bias the body portions toward each other when each the toggle linkages are positioned in the first favored position.

32 Claims, 8 Drawing Sheets

COLLAPSIBLE MUSIC STAND

This application claims priority under 35 U.S.C. §119(e) to U.S. Provisional Patent Application Serial No. 60/361,674, filed Mar. 5, 2002, said application also being fully incorporated herein by reference.

BACKGROUND OF THE INVENTION

Music stands that are collapsible for ease of storage and handling are well known. One commonly used design has a music desk comprising stays or wires connected in a scissors arrangement, and attached to an upright base. An example of this type is found in U.S. Pat. No. 6,260,812 to Auke disclosing a collapsible music stand comprising a rod shaped central upright supported by legs and with a head consisting of extendable stays that can be folded. Stands of this type, however, typically lack rigidity in the desk assembly. As a result, they often do not provide adequate support for sheets of music, especially when the music is thin or is of a large size. Neither are they suitable for supporting heavy items such as books.

Another type of stand has a solid music desk comprised of folding platens, hinged together in any number of arrangements. An example of this type is found in U.S. Pat. No. 5,979,856 issued to Hsu. The folding platens of this type, however, generally make the stand heavy and bulky when folded.

Both types of prior art stands generally lack means for easily and securely adjusting tilt of the desk. Often, no adjustment at all for tilt is provided. If provided, the means used sometimes relies on friction between two parts to maintain a selected position. Such an arrangement is prone to undesired movement if bumped or even if a heavier object is placed on the desk. Other arrangements involve parts secured with a screw or bolt. Such arrangements, however, have the disadvantage of being hard to adjust and manipulate, and difficult to disassemble for storage or transport.

What is needed is a stand that is easily collapsible into a compact form, while having a rigid desk assembly when deployed. Such a stand should be capable of handling very large and thin music sheets as well as books and other heavy items at a variety of desk tilt angles.

SUMMARY OF THE INVENTION

The present invention is a collapsible music stand that addresses the problems found in the prior art. The stand generally includes a desk assembly, an upright assembly and a base.

In preferred embodiments, the desk is collapsible, and includes a lower music rest and a crown member connected at the sides by an arrangement of pivoted arms. When extended so that the desk is in a deployed condition with the music rest and crown member spaced apart, the arms are positioned in an "over-center" arrangement with the pivot of the arms displaced to one said of a center axis which extends through the ends of each arm. The arms are biased against arm stops on the music rest and the crown member by elastic or spring bias members that act to pull the top member towards the music rest. This arrangement provides a very rigid desk suitable for supporting heavy items. When desired, the desk can be collapsed by pressing the arms inward and pushing the top member toward the music rest. Recesses for the arms may be provided so that the desk folds into a compact package.

A quick-connect device may be provided so that the desk is easily and quickly detachable from the base and upright.

Desk tilt is preferably user adjustable with a hand operable spring-loaded tilt adjustment apparatus having a number of discrete positions. Also, extensible clips may be provided to support large sheets of music or other matter.

The upright assembly may be height adjustable by means of telescoping members that are held in a desired position with a compression fitting. The telescoping members also allow the upright assembly to be collapsed into a compact form.

In preferred embodiments, the base assembly may include pivoted legs that are inwardly foldable. In use, the base assembly may be secured to the bottom of the upright assembly with a threaded connection. The base assembly can thus be unthreaded and the mounting hub slid along the upright assembly when the stand is collapsed. Thus, with legs folded, the base and upright assembly assume a compact, easily transportable and storable form.

Thus, a collapsible music stand according to the present invention includes a ground engaging base portion, an upright portion, and a selectively collapsible desk detachably operably coupled to the upright portion. The desk has a pair of body portions operably coupled by a pair of over-center toggle linkages. Each over-center toggle linkage is selectively positionable in at least a first favored position, wherein the linkage is extended so that the body portions are spaced apart and the linkage opposes movement of the body portions toward each other. Further, the toggle linkages are positionable in a second favored position wherein the body portions are freely movable toward each other to collapse the desk. The desk further includes at least one resilient element arranged so as to bias the body portions toward each other when each the toggle linkages are positioned in the first favored position. The music stand may also include a tilt mechanism enabling the desk to be selectively positioned at any of a plurality of predetermined discrete tilt positions. Extensible music clips may be included to enable the desk to support music pieces having extended width dimensions.

The present invention may also be characterized as including a music stand with a ground engaging base portion, an upright portion, and a selectively collapsible desk detachably operably coupled to the upright portion. The desk includes a pair of articulating arm assemblies, each having a pair of opposing ends and including a pair of links connected at a pivot, each arm assembly presenting a center axis extending through the ends. Further, the desk includes a pair of opposing body portions arranged so as to operably couple the pair of body portions. The body portions and the arm assemblies have cooperating stop structures defining a favored deployed position of the desk wherein the body portions are spaced apart and the pivot of each arm assembly is laterally displaced from the center axis in a first direction. The arm assemblies and the body portions are adapted so that when the pivot of each said arm assembly is laterally displaced from the center axis in a second direction opposite the first direction, the desk is positionable in a favored collapsed position wherein said arm assemblies are folded and the body portions are adjacent each other. At least one resilient element is provided coupling the body portions and arranged so as bias the desk in the deployed position.

DETAILED DESCRIPTION OF THE PREFERRED EMBODIMENTS

Figure 10:
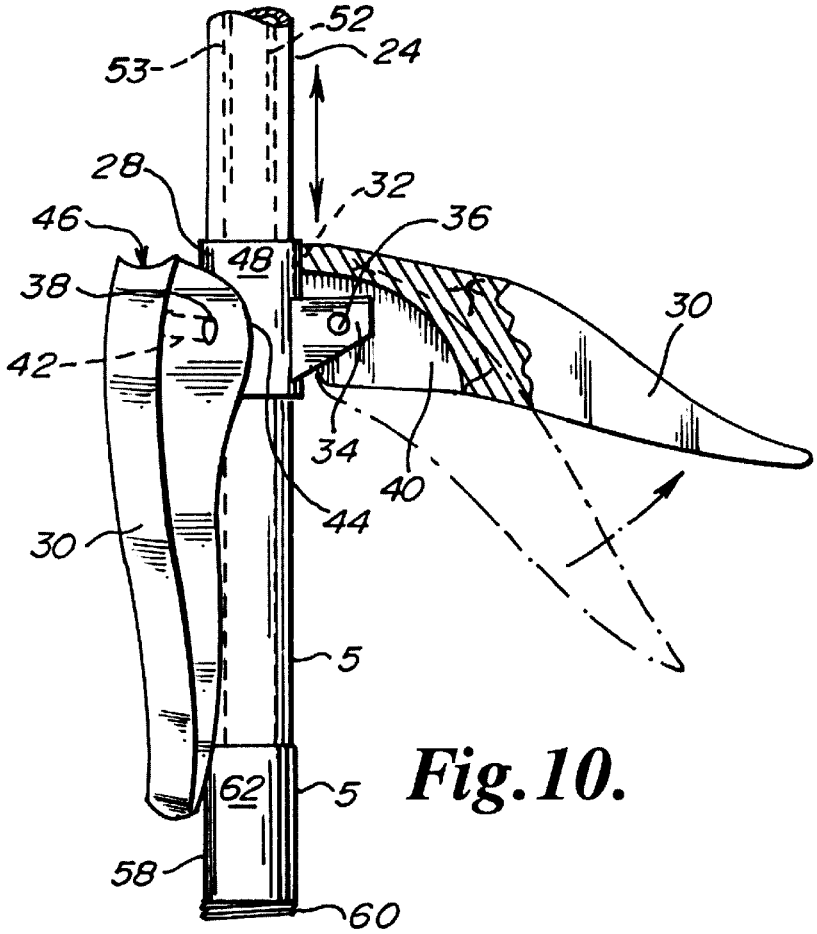
FIG. 10 is a view of the connection details of the base portion and upright portion of the stand.

Collapsible music stand 20 generally includes a base portion 22, an upright portion 24, and a desk 26. When collapsed, desk 26 may be detached from upright portion 24, and base portion 22 may be positioned axially along upright portion 24 as depicted in FIG. 10, thus presenting compact components that can be easily moved and stored.

Base portion 22 generally includes a hub portion 28 and legs 30. Hub portion 28 is generally cylindrical in shape and has a longitudinal bore 32, a portion of which may be internally threaded. Leg mount tabs 34 project radially from hub portion 28, each having an aperture 36 for receiving a pivot pin 38. Each of legs 30 has a recess 40 for receiving one of leg mount tabs 34. Bore 42 extends through leg 30 and is positioned so as to correspond with aperture 36 when the tab 34 is received in recess 40. Pivot pin 38 extends through bore 42 and aperture 36 so that each leg 30 is pivotally attached to hub portion 28 at pivot pin 38. The bottom peripheral corner 44 of leg 30 may be rounded as depicted in FIG. 10 to enable the pivoting movement. Also, the inner face 46 of leg 30 may be concave so as to fit conformingly with outer surface 48 of hub portion 28.

Upright portion 24 generally includes an outer shaft portion 50, an inner telescoping shaft portion 52, a bottom cap 54 and a desk connector portion 56. Bottom cap 54 fits on the bottom end 58 of outer shaft portion 50, and may have a threaded portion 60 on the outer surface 62 thereof. Outer shaft portion 50 may be sized so as to slidably fit through longitudinal bore 32 of hub portion 28, and be slidable thereon, as depicted in FIG. 10. Threaded portion 60 may thread into the internal threads of longitudinal bore 32 so that base portion 22 may be secured to upright portion 24.

Figure 18:
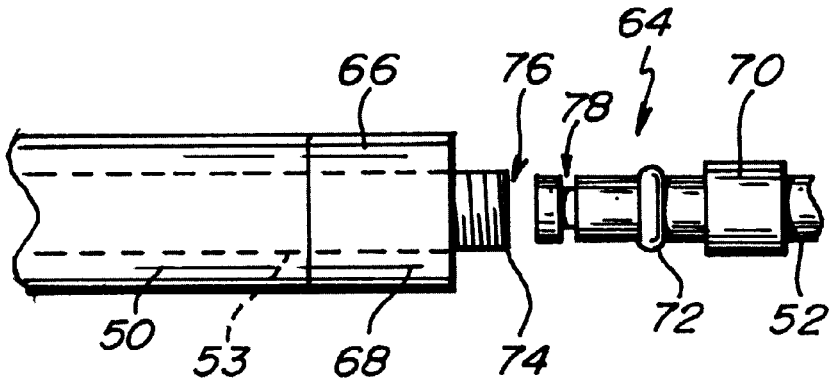
FIG. 18 is a partially exploded view of a compression fitting height adjustment for the upright assembly.

Inner telescoping shaft portion 52 is axially slidable within an axially oriented bore 53 in outer shaft portion 50. The axial position of inner telescoping shaft portion 52 can be fixed with respect to outer shaft portion 50 using height adjustment assembly 64 shown in FIG. 18. Height adjustment assembly 64 generally includes a top cap 66 disposed over the top end 68 of outer shaft portion 50, a ferrule 70, and a compression sleeve 72.

In operation, after inner telescoping shaft portion 52 is slidably positioned at a desired position within outer shaft portion 50, ferrule 70, which is interiorly threaded, is threaded onto threaded portion 74 of top cap 66. As ferrule 70 is tightened, compression sleeve 72 is forced into the annular space 76 between inner telescoping shaft portion 52 and outer shaft portion 50. The increased friction between inner telescoping shaft portion 52 and outer shaft portion 50 acts to resist relative axial sliding and to thus maintain the desired position. In a preferred embodiment, inner telescoping shaft portion 52 may be retained within outer shaft portion 50 by a friction sleeve (not depicted) inserted in groove 78 and adapted to engage top cap 66 so as to prevent withdrawal of inner telescoping shaft portion 52. It will of course be appreciated that any other suitable arrangement could also be used to retain inner telescoping shaft portion 52, including a flared end.

Desk 26 generally includes a first body portion 80 which may be a music rest 82, a second body portion 84 which may be a crown member 86, a pair of articulating arm assemblies 88 in the form of over-center toggle linkages 90, and resilient tension members 92. Each articulating arm assembly 88 generally includes a pair of arm links 94, 96, pivotally coupled at a pivot 98 forming a toggle linkage. Each articulating arm assembly 88 presents a center axis 100, which extends through the opposing ends 102, 104 of the assembly 88.

Music rest 82 generally includes a back portion 106 and a tray portion 108. Tray portion 108 projects generally perpendicularly from front side 110 of back portion 106 proximate bottom edge 112. One or more longitudinal grooves 114 may be provided on tray portion 108 to retain the bottom edge of music, as well as pencils, batons or other items. Front side 110 of back portion 106 further has a recessed region 116 formed therein for receiving arm links 96 when folded as will be explained in further detail hereinbelow. Recessed region 116 is defined by a perpendicular surface 120.

Crown member 86 generally includes a main portion 122 and an arcuate handle portion 124. Main portion 122 has a pair of recessed regions 126, defined by perpendicular surfaces 128, for receiving arm links 94 when folded. Arcuate handle portion 124 is attached to main portion 122 above cutout 130.

Figure 1:
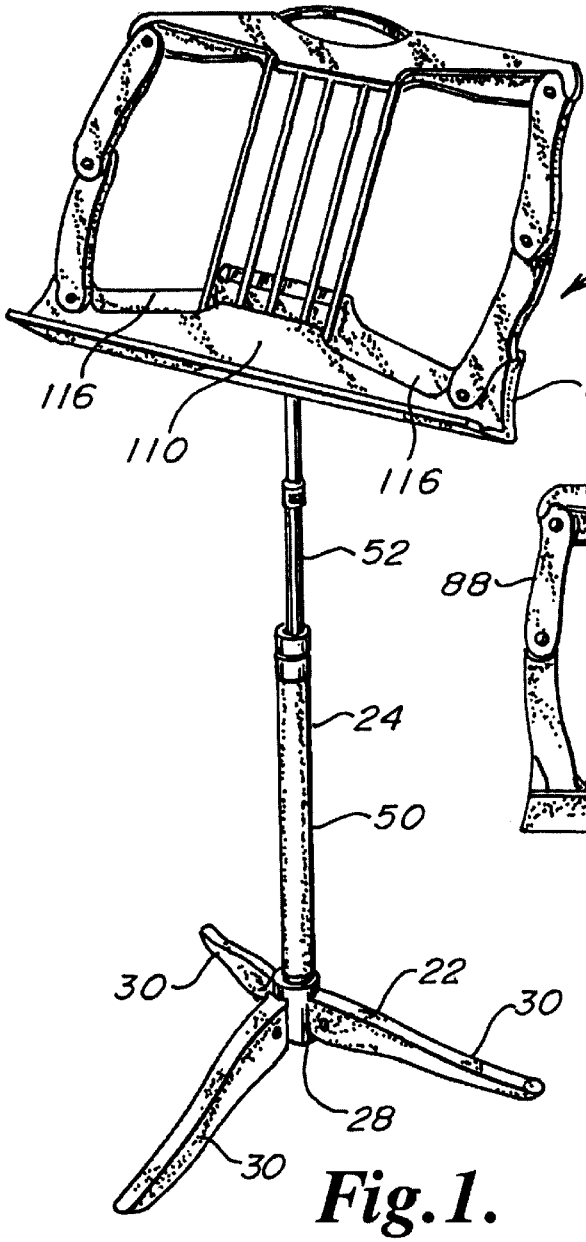
FIG. 1 is a perspective view of a music stand according to the present invention in a fully deployed position.
Figure 2:
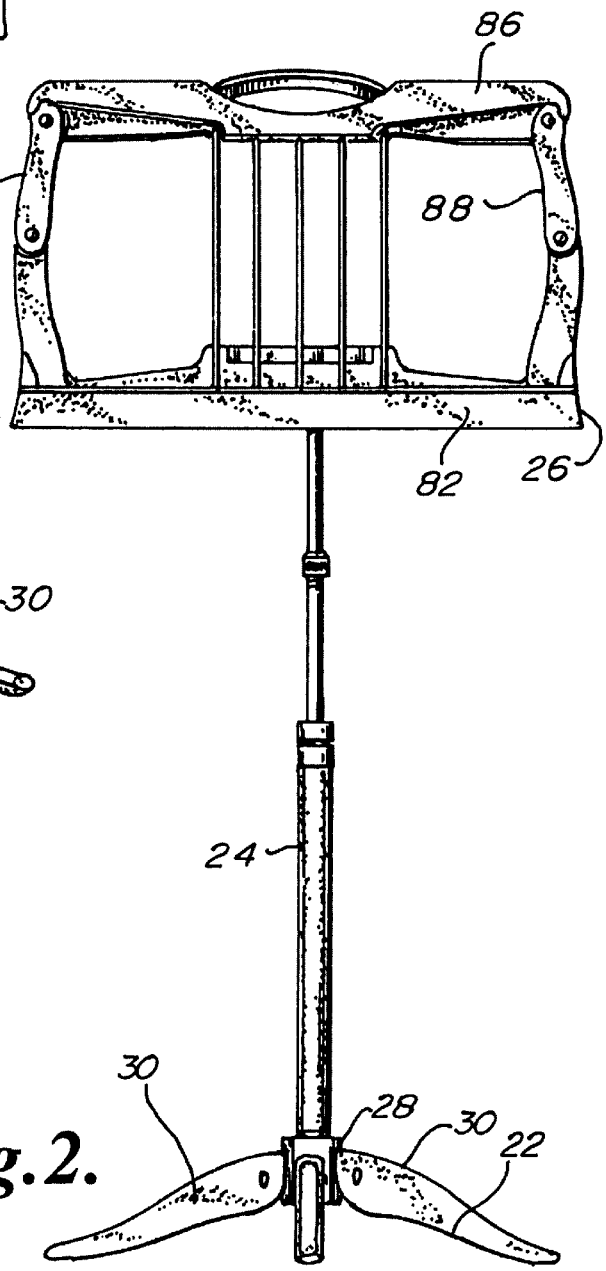
FIG. 2 is a frontal elevation view of the stand of FIG. 1.
Figure 3:
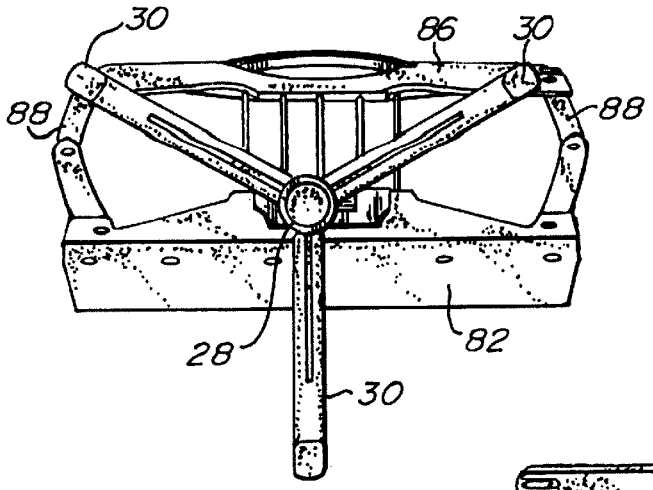
FIG. 3 is a bottom plan view of the stand of FIG. 1.
Figure 4:
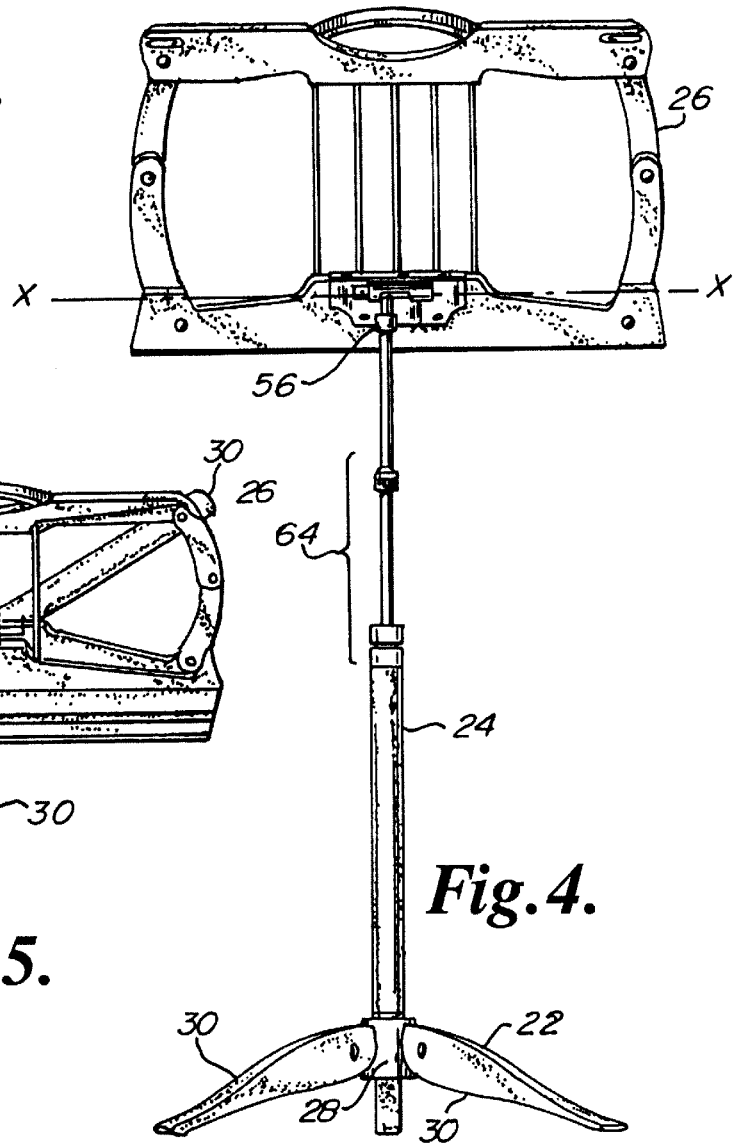
FIG. 4 is a rear elevation view of the stand of FIG. 1.
Figure 5:
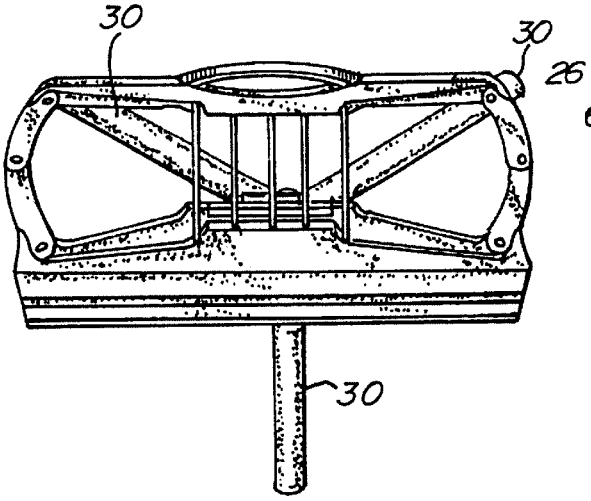
FIG. 5 is a top plan view of the stand of FIG. 1.
Figure 6:
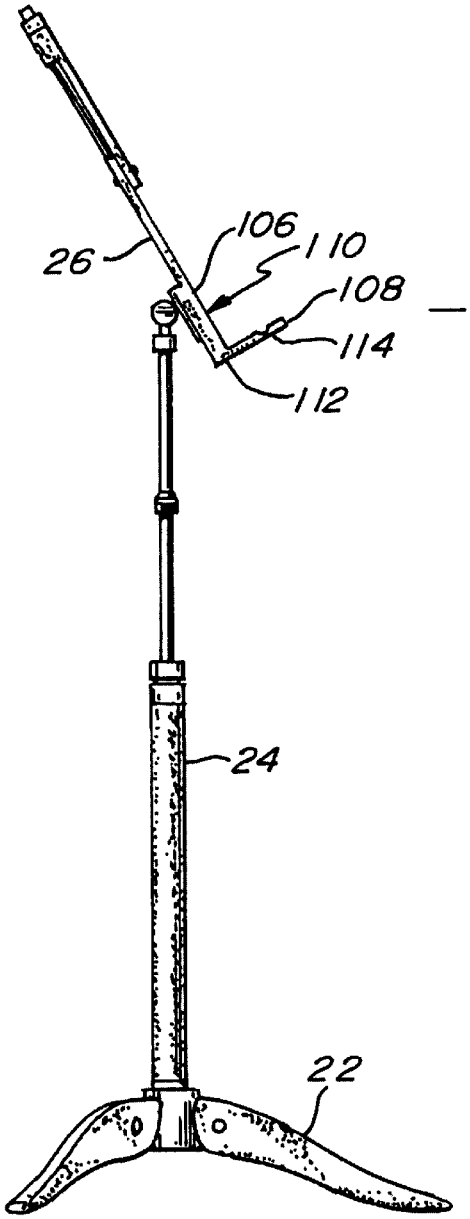
FIG. 6 is a side elevation view of the stand of FIG. 1.
Figure 12:
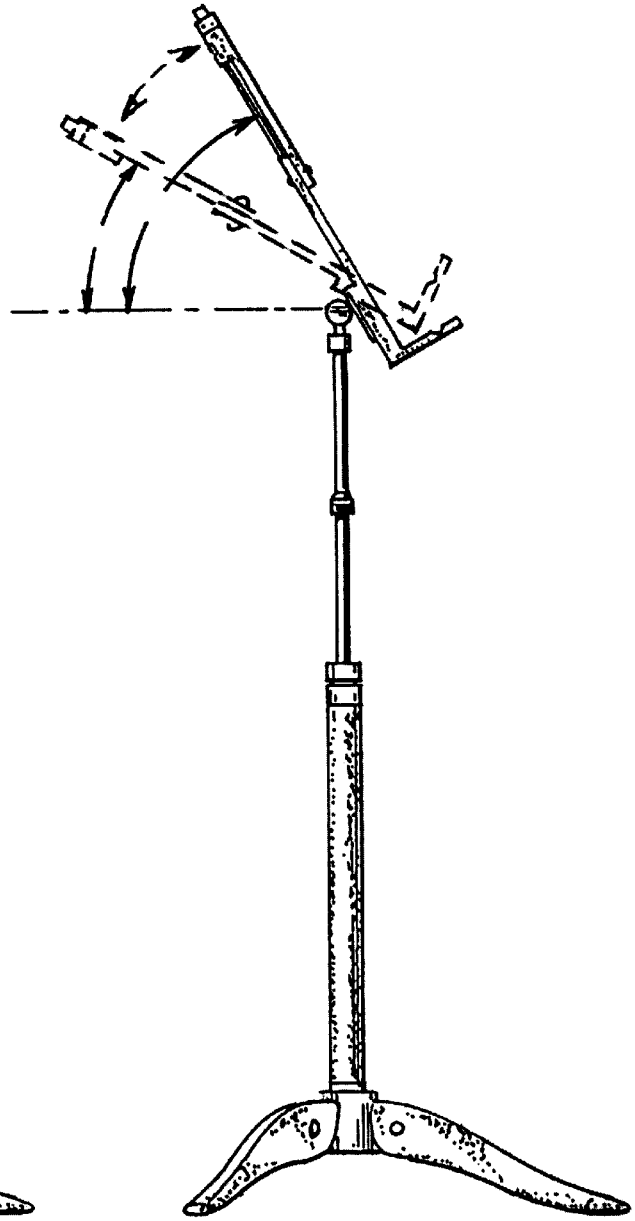
FIG. 12 is side elevation view of the stand depicting desk tilt angle adjustment.
Figure 7:
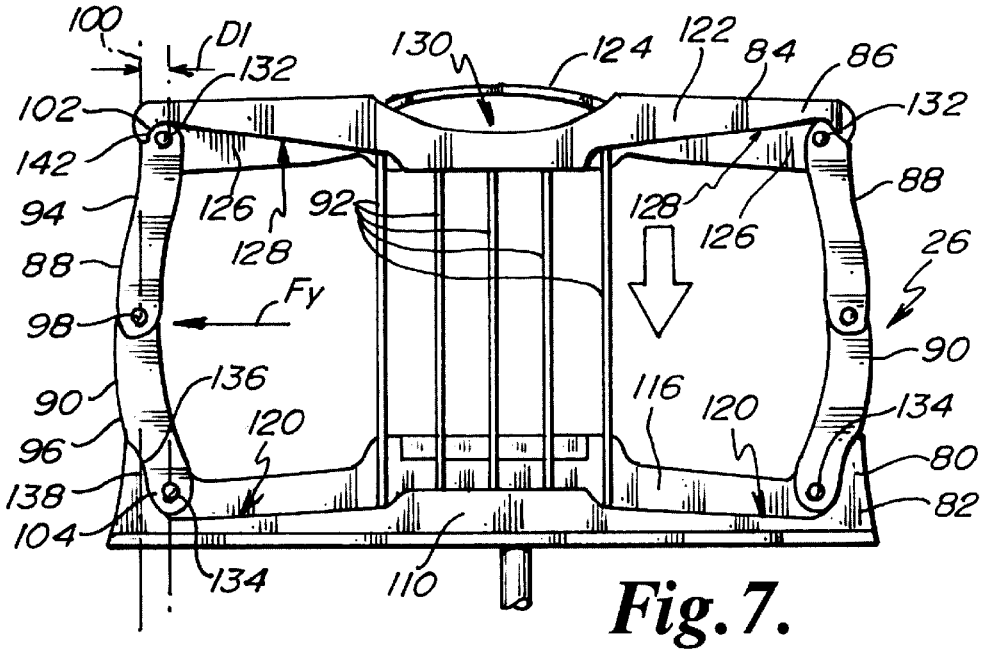
FIG. 7 is a front elevation view of the desk in a fully deployed position.

Each arm link 94 is pivotally coupled to crown member 86 in one of recessed regions 126 at an upper pivot 132, and each arm link 96 is pivotally attached to music rest 82 in recessed region 116 at a lower pivot 134. When desk 26 is in a first favored deployed position as depicted in FIG. 7, edge 136 of arm link 96 engages arm stop portion 138 of perpendicular surface 120, and edge 140 of arm link 94 engages arm stop portion 142 of perpendicular surface 128. Arm links 94, 96, are thereby prevented from any further outward lateral rotational movement about upper pivot 132 and lower pivot 134 respectively. Also, when edge 136 is engaged with arm stop portion 138 and edge 140 is engaged arm stop portion 142, pivot 98 is disposed laterally outboard from center axis 100 by a distance annotated D1 in the drawings, being thus disposed slightly "over-center".

One or more resilient tension members 92 are connected between music rest 82 and crown member 86 so as to exert a biasing force tending to pull music rest 82 and crown member 86 toward each other, as indicated by the arrow in FIG. 7. The biasing force exerted by tension members 92 is resisted by the arm assemblies 88. Since pivot 98 is disposed outwardly from center axis 100, the biasing force has a horizontal component, annotated FY, acting to force pivot 98 outwardly and to force edges 136, 140, into arm stop portions 138, 142, respectively. In this deployed position, desk 26 has a stable, generally rectangular shape.

Tension members 92 are preferably elastic cords made from resilient material such as nylon. It will be readily appreciated that other elastic or spring biasing means that accomplish the purpose of providing a biasing force for drawing crown member 86 toward music rest 82 may be used according to the invention. For example, an arrangement of coil springs could be used. Another example could involve wire, string members, straps, or the like equipped with retractors for example, spring-loaded retractors, concealed or positioned in the music rest 82 or crown member 86.

Figure 8:
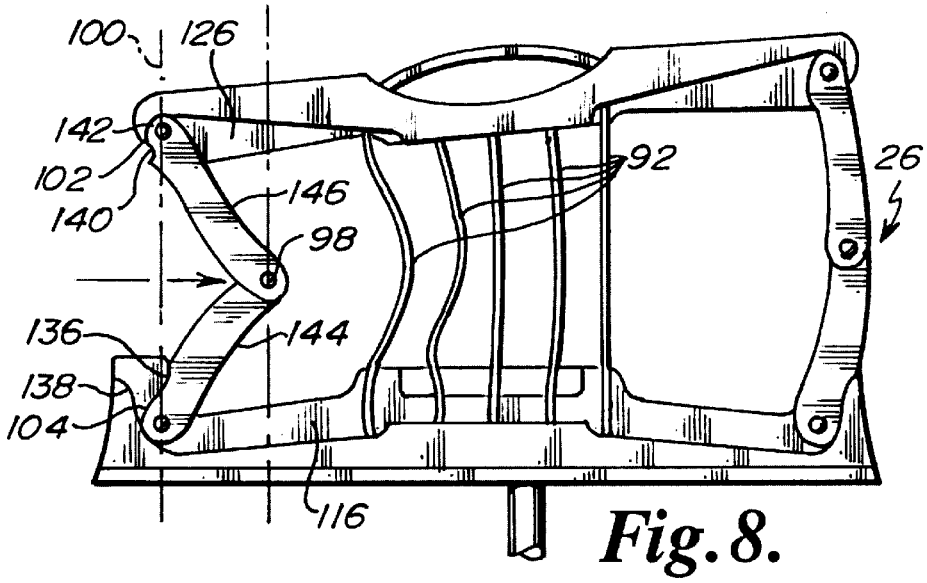
FIG. 8 is a front elevation view of the desk in a partially collapsed position.
Figure 9:
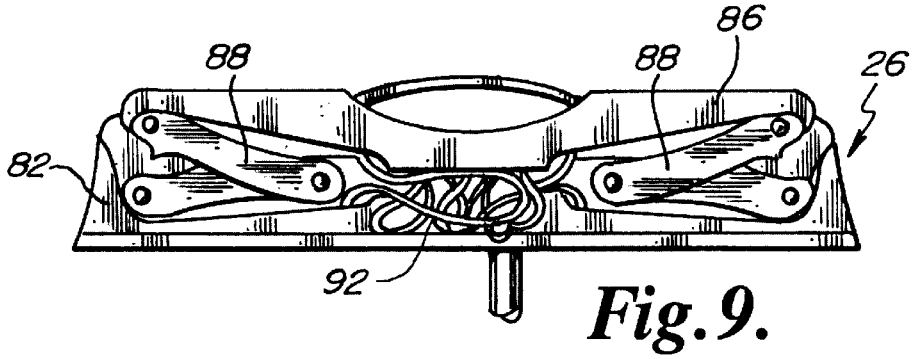
FIG. 9 is a front elevation view of the desk in a fully collapsed position.

Desk 26 is depicted in a partially collapsed configuration in FIG. 8, and in a fully collapsed position in FIG. 9. To collapse desk 26, pivots 98 are pushed inward to the other side of center axis 100 as depicted in FIG. 8, thereby pivoting arm links 94, 96, about upper and lower pivots 132, 134, respectively, and away from arm stop portions 138, 142. Arm links 94, 96, pivot inward into recessed regions 116, 126, until edges 144, 146, are proximate perpendicular surfaces 120, 128, and crown member 86 is proximate or even contacting music rest 82 as depicted in FIG. 9. Tension members 92 fold in on themselves, or alternatively, could be provided with a retraction mechanism (not depicted) to take up any slack.

In addition to the embodiment depicted here, it will be appreciated that a variety of alternative arrangements of cooperating structures are possible on arm assemblies 88 and first and second body portions 80, 84, to position the desk components in the favored deployed position. For example, suitable structures on the arm assemblies 88 adapted and positioned to engage with portions of body portions 80, 84, could be substituted for the arm stop portions 138, 142 on body portions 80, 84.

Desk 26 may be detachably coupled to upright portion 24 by any suitable method or mechanism. In a preferred embodiment, depicted in FIG. 13, a standard female quick-connect air hose connector fitting 148 is affixed to the upper end 150 of inner telescoping shaft portion 52 of upright portion 24. A cooperating male fitting 152 of the air hose connector is affixed to desk 26 and is arranged to face downwardly. Desk portion 26 may thereby be attached and detached from upright portion 24 by engaging and disengaging male fitting 152 from female fitting 148.

Figure 14:
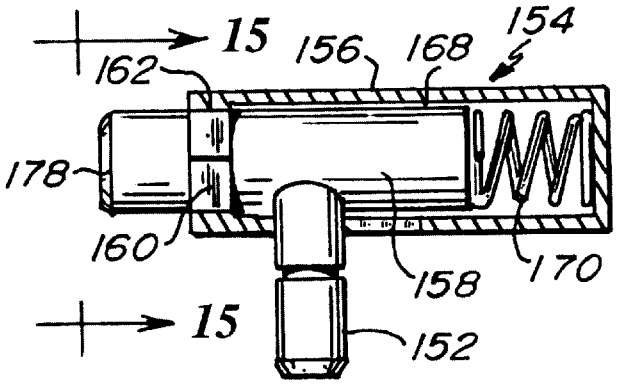
FIG. 14 is a cross-sectional view of the desk tilt adjustment assembly of FIG. 13.
Figure 15:
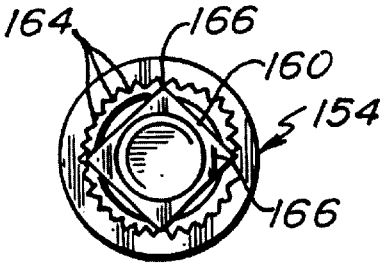
FIG. 15 is an end elevation view of the desk tilt adjustment assembly.

Music stand 20 may include a desk tilt adjustment assembly 154 for providing a tilt adjustment of desk 26 about a horizontal axis, annotated x—x in the drawings. Tilt adjustment assembly 154 generally includes an outer, hollow portion 156 and an inner portion 158. Inner portion 158 is axially slidable within outer portion 156, and has a portion 160 with a generally square cross-section. Outer portion 156 has a proximal portion 162 with a plurality of inwardly directed notches 164, which are adapted to engage the shoulders 166 of portion 160. It will be appreciated that, when inner portion 158 is axially positioned in a first position so that shoulders 166 are engaged with notches 164, outer and inner portions 156, 158, are rotationally fixed together. It will be appreciated that notches 164 define discrete rotational positions for inner portion 158 within outer portion 156. When inner portion 158 is axially positioned in the direction of the arrows as depicted in FIG. 14 in a second position wherein portion 160 is within distal portion 168 of outer portion 156, inner portion 158 is freely rotatable therein. A compression spring 170 may be provided to bias inner portion 158 toward the first position. As will be readily appreciated, any other suitable arrangement, such as a solid piece of resilient material, may be used in place of compression spring 170.

Figure 13:
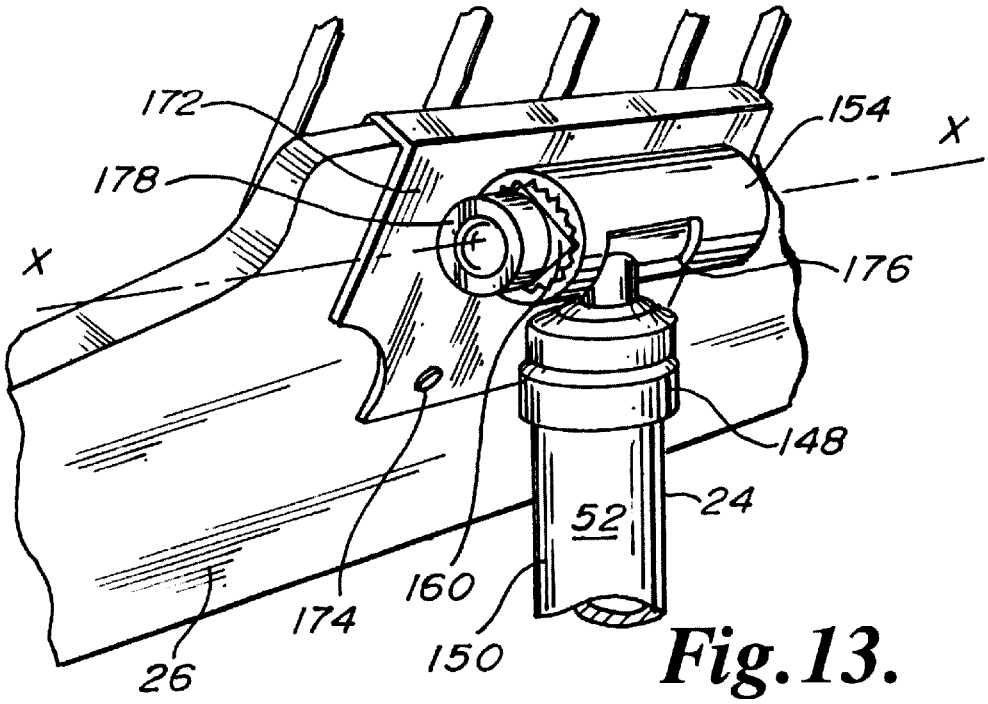
FIG. 13 is an enlarged perspective view of the desk tilt adjustment assembly.

In the preferred embodiment depicted in FIG. 13, outer portion 156 is connected to mounting plate 172, which in turn is attached to desk 26 with fasteners 174. Male fitting 152 projects from inner portion 158 through an aperture 176 in outer portion 156 and is received in female connector fitting 148 of upright portion 24 as previously described. A button 178 may be provided on inner portion 158 to enable axial positioning of inner portion 158 by a user.

The operation of desk tilt adjustment assembly 154 may now be understood by reference to FIGS. 12–15. When disposed in the first position described above, inner portion 158 is rotationally fixed to outer portion 156, thereby fixing desk 26 at a tilt angle, annotated $\alpha$ in the drawings. When button 178 is depressed, inner portion 158 slides axially inward, disengaging shoulders 166 from notches 164. In this position, inner portion 158 is rotatable within outer portion 156, enabling desk 26 to be tilted to any desired tilt angle $\alpha$ within the rotational range of travel of the mechanism. Once desk 26 is positioned at the desired angle, compression spring 170 returns inner portion 158 to the first position with shoulders 166 engaging notches 164, thereby fixing desk 26 at the desired angle.

It will of course be appreciated that numerous variations of desk tilt adjustment assembly 154 are possible. For example, the number of discrete tilt positions provided by the mechanism may be varied, depending on the number and spacing of notches 164. Also, the position of the cooperating structures could be reversed, with notches 164 being on inner member 158 and a suitable engaging structure on outer member 156. In addition, the orientation of the desk tilt adjustment assembly itself could be reversed so that desk 26 is connected to inner portion 158 and upright member 24 is connected with outer portion 156.

Figure 11:
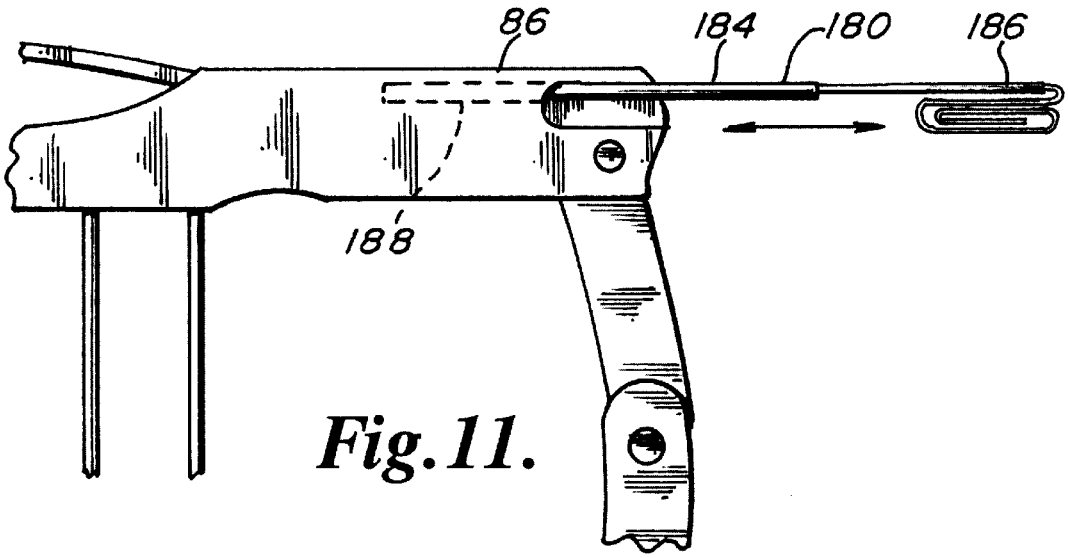
FIG. 11 is a view of an extensible clip assembly according to the invention.
Figure 16:
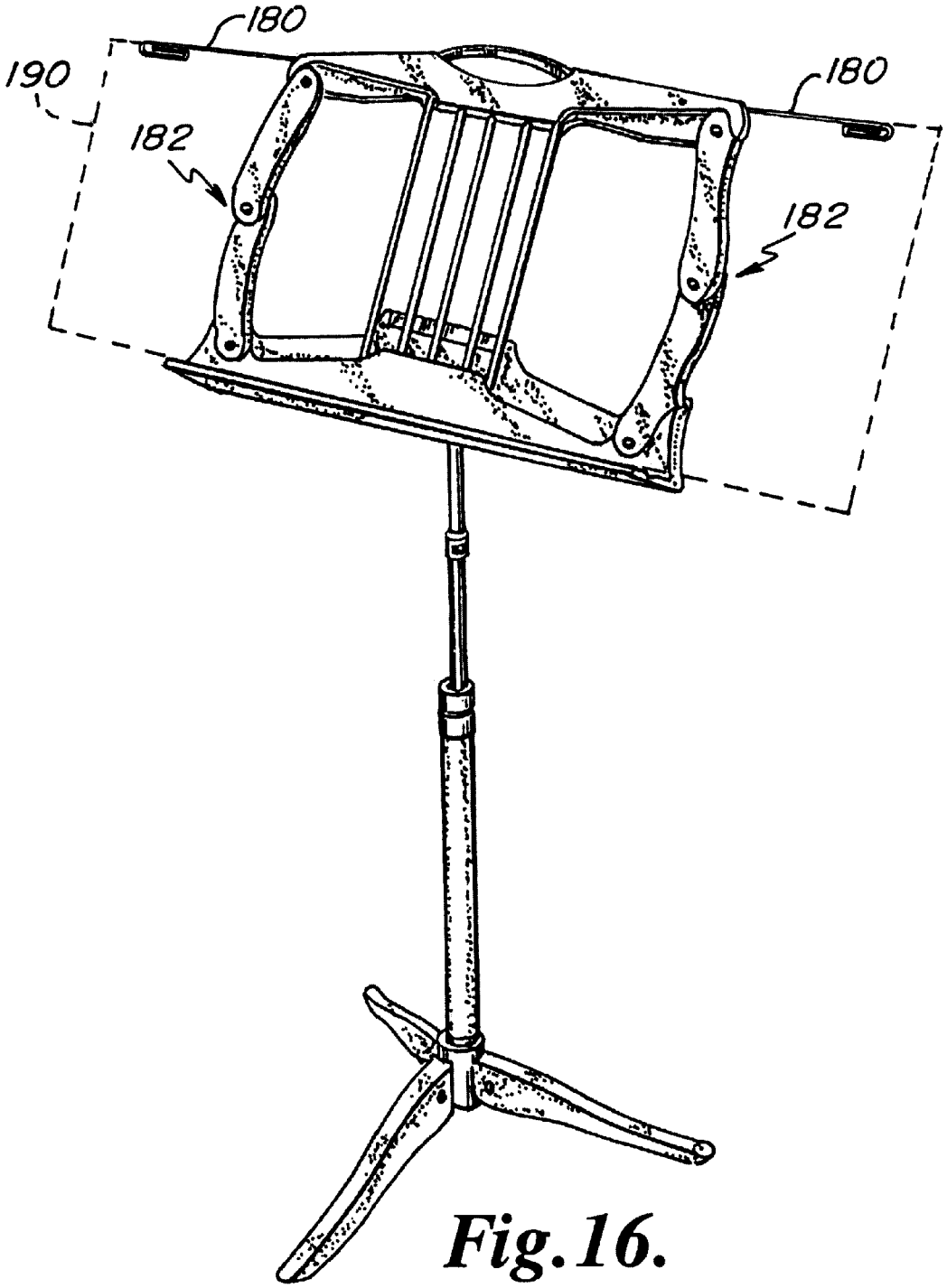
FIG. 16 is a perspective view of the stand depicting the extensible clips supporting a piece of music.

The music stand 20 of the present invention may also be provided with one or more extensible music clips 180 as depicted in FIGS. 11 and 16 for holding large width sheet music pieces 190 that may extend beyond the lateral margins 182 of desk portion 26. Each music clip 180 generally includes a telescoping rod portion 184 and a paper clip 186. Music clip 180 may be arranged so as to retract within a recess 188 provided for the purpose in crown member 86.

In operation, music clip 180 may be pulled laterally outward by a user to extend telescoping rod portion 184, thereby positioning paper clip 186 at a suitable position for supporting an extra width piece of sheet music 190 as depicted in FIG. 16.

Figure 17:
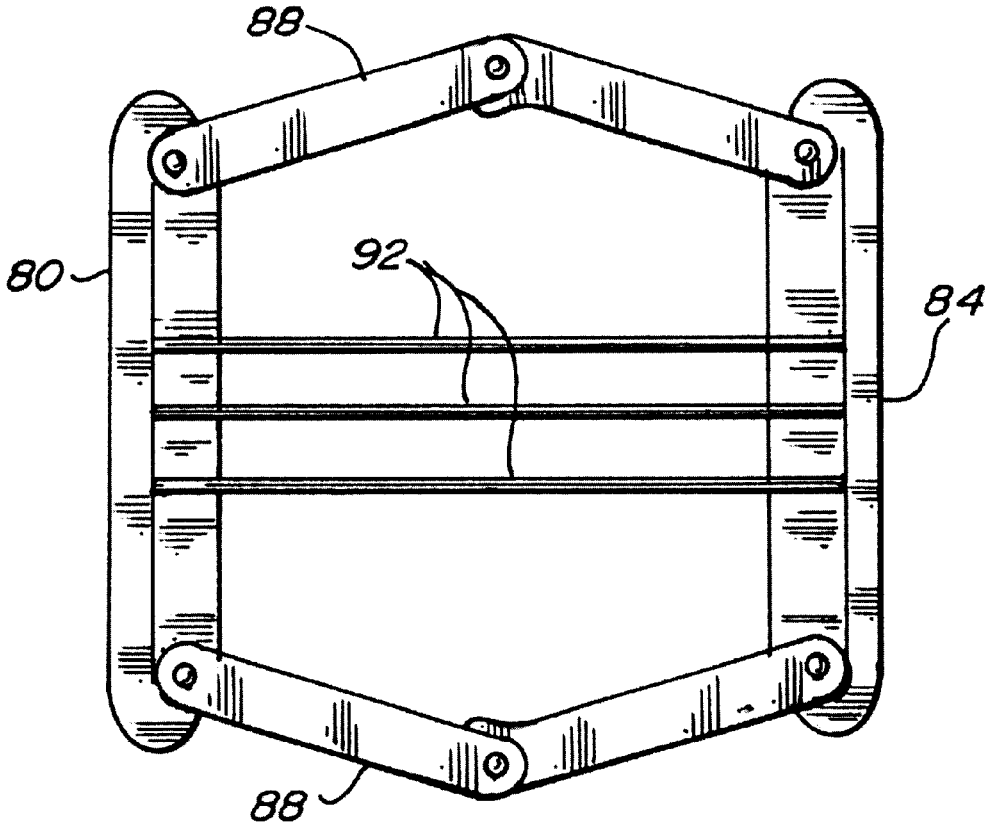
FIG. 17 is a front elevation view of an alternative embodiment of a desk assembly according to the present invention.

In addition to the embodiments depicted in FIGS. 1–16, it will be recognized that other arrangement of the over-center articulating arm sets 88 and body portions 80, 84, of desk portion 26 are possible. For example, as depicted in FIG. 17, the arm sets 88 may be disposed at the top and bottom of the desk 26, while body portions 80, 84 are laterally opposed.

What is claimed is:

1. A collapsible music stand comprising:

a ground engaging base portion;

an upright portion operably coupled to said base portion; and a selectively collapsible desk detachably operably coupled to said upright portion, said desk including a pair of body portions operably coupled by a pair of over-center toggle linkages, each over-center toggle linkage being selectively positionable in at least a first favored position, wherein said linkage is extended so that said body portions are spaced apart and said linkage opposes movement of said body portions toward each other, and a second favored position wherein said body portions are freely movable toward each other to collapse said desk, said desk further including at least one resilient element arranged so as to bias said body portions toward each other when each said toggle linkage is positioned in said first favored position.

2. The music stand of claim 1, wherein said pair of body portions includes a lower rest portion and an upper crown portion.

3. The music stand of claim 1, wherein said resilient element comprises a cord formed from resilient material.

4. The music stand of claim 1, wherein said ground engaging base portion includes a hub portion and a plurality of selectively foldable legs operably coupled to said hub portion.

5. The music stand of claim 1, wherein said upright portion is selectively detachably coupled to said base portion.

6. The music stand of claim 5, wherein upright portion and said base portion are threadably coupled.

7. The music stand of claim 1, further comprising a tilt mechanism operably coupling said desk and said upright portion and arranged so that said desk is tiltably adjustably positionable about a generally horizontal axis.

8. The music stand of claim 7, wherein said tilt mechanism is adapted to enable said desk to be selectively positioned at any of a plurality of predetermined discrete tilt positions.

9. The music stand of claim 8, wherein said tilt mechanism includes an elongate hollow outer portion and an inner portion axially slidably disposed therein, wherein said inner portion is selectively axially positionable in at least a first favored position and a second favored position, wherein said inner and outer portions have cooperating structures for rotationally fixing said inner portion in said outer portion when said inner portion is in said first favored position, and wherein said inner portion is freely rotatable in said outer portion when said inner portion is in said second favored position.

10. The music stand of claim 9, wherein said tilt mechanism further includes a resilient biasing element arranged so as to bias said inner portion toward said first position.

11. The music stand of claim 9, wherein said cooperating structures comprise a plurality of notches in said outer portion and at least one shoulder on said inner portion adapted to engage one of said notches in said outer portion.

12. The music stand of claim 1, further comprising at least one extensible clip adapted to engage and hold a piece of sheet music, said clip arranged so as to be selectively laterally extendable from said desk.

13. The music stand of claim 12, wherein said clip includes a telescoping rod and a paper clip on an end of said rod.

14. The music stand of claim 1, wherein said upright assembly is height adjustable.

15. A collapsible music stand comprising:

a ground engaging base portion;

an upright portion operably coupled to said base portion; and a selectively collapsible desk detachably operably coupled to said upright portion, , the desk including:

a pair of articulating arm assemblies, each having a pair of opposing ends and including a pair of links connected at a pivot, each said arm assembly presenting a center axis extending through said ends;

a pair of opposing body portions, said pair of arm assemblies arranged so as to operably couple said pair of body portions, said body portions and said arm assemblies having cooperating stop structures defining a favored deployed position of said desk wherein said body portions are spaced apart and the pivot of each said arm assembly is laterally displaced from the center axis in a first direction, said arm assemblies and said body portions adapted so that when the pivot of each said arm assembly is laterally displaced from said center axis in a second direction opposite said first direction, said desk is positionable in a favored collapsed position wherein said arm assemblies are folded and said body portions are adjacent each other; and at least one resilient element coupling said body portions and arranged so as bias said desk in said deployed position.

16. The music stand of claim 15, wherein said pair of body portions includes a lower rest portion and an upper crown portion.

17. The music stand of claim 15, wherein said resilient element comprises a cord formed from resilient material.

18. The music stand of claim 15, wherein said ground engaging base portion includes a hub portion and a plurality of selectively foldable legs operably coupled to said hub portion.

19. The music stand of claim 15, wherein said upright portion is selectively detachably coupled to said base portion.

20. The music stand of claim 19, wherein upright portion and said base portion are threadably coupled.

21. The music stand of claim 20, wherein said tilt mechanism is adapted to enable said desk to be selectively positioned at any of a plurality of predetermined discrete tilt positions.

22. The music stand of claim 21, wherein said tilt mechanism includes an elongate hollow outer portion and an inner portion axially slidably disposed therein, wherein said inner portion is selectively axially positionable in at least a first favored position and a second favored position, wherein said inner and outer portions have cooperating structures for rotationally fixing said inner portion in said outer portion when said inner portion is in said first favored position, and wherein said inner portion is freely rotatable in said outer portion when said inner portion is in said second favored position.

23. The music stand of claim 22, wherein said tilt mechanism further includes a resilient biasing element arranged so as to bias said inner portion toward said first position.

24. The music stand of claim 22, wherein said cooperating structures comprise a plurality of notches in said outer portion and at least one shoulder on said inner portion adapted to engage one of said notches in said outer portion.

25. The music stand of claim 15, further comprising at least one extensible clip adapted to engage and hold a piece of sheet music, said clip arranged so as to be selectively laterally extendable from said desk.

26. The music stand of claim 15, wherein said upright portion is height adjustable.

27. A collapsible music stand comprising:

a ground engaging base portion;

an upright portion operably coupled to said base portion; and a selectively collapsible desk detachably operably coupled to said upright portion, said desk positionable in a deployed position and a collapsed position, the desk including:

a pair of opposing body portions;

a pair of articulating arm assemblies operably coupling said body portions, each said arm assembly including a pair of links coupled at a pivot, each said arm assembly further having a pair of opposing ends and presenting a center axis extending through said ends;

means for defining a favored deployed position for said desk, wherein said body portions are spaced apart and said arm assemblies are extended with said pivot laterally displaced from said center axis in a first direction; and resilient means coupling said body portions and arranged so as to bias said desk in said favored deployed position.

28. The music stand of claim 27, wherein said means for defining a favored deployed position for said desk include a pair of arm stop structures on each of said body portions.

29. The music stand of claim 27, wherein said resilient means includes a cord formed from resilient material attached between said pair of body portions.

30. The music stand of claim 27, further comprising means for selectively tiltably adjusting said desk portion about a generally horizontal axis.

31. The music stand of claim 27, further comprising means adapted to support a piece of sheet music extending laterally from said desk.

32. The music stand of claim 27, wherein said upright portion is height adjustable.

* * * * *